US005140736A

United States Patent [19]

Hsiao

[11] Patent Number: 5,140,736

[45] Date of Patent: Aug. 25, 1992

[54] BICYCLE CHAIN RIVET DISMANTLING APPARATUS

[76] Inventor: K. H. Hsiao, No. 4, Lane 11, Tze Chiang St., Tu Cheng Shiang Taipei Shien, Taiwan

[21] Appl. No.: 845,720

[22] Filed: Mar. 4, 1992

[51] Int. Cl.[5] ..... B25B 1/24

[52] U.S. Cl. ..... 29/243.54

[58] Field of Search ..... 29/243.53, 243.54, 257, 29/243.55, 283.5, 522, 509; 264/102; 59/7, 11; 72/965, 966, 391, 396, 453.19, 453.15, 453.17, 453.16, 312, 313

[56] References Cited

U.S. PATENT DOCUMENTS

| | | | |
|---|---|---|---|
| 3,182,442 | 5/1965 | Granberg | 29/243.54 |
| 3,233,402 | 2/1966 | Urbaitis | 29/243.54 |
| 3,234,634 | 2/1966 | Johnson et al. | 29/243.54 |
| 4,365,401 | 12/1982 | Ogren | 29/243.53 |
| 4,476,615 | 10/1984 | Cook | 29/243.54 |
| 4,602,414 | 7/1986 | Bartholomew et al. | 29/243.54 |
| 4,949,446 | 8/1990 | Kowica | 29/243.53 |

*Primary Examiner*—Robert C. Watson
*Attorney, Agent, or Firm*—Bacon & Thomas

[57] ABSTRACT

For dismantling a rivet from either side-plate of a link of a bushed chain, a bicycle chain rivet dismantling apparatus comprised of a base having a first bolt hole and a second bolt hole longitudinally aligned at two opposite ends thereof and spaced from an intermediate stop wall, a screw thread bush fastened in said second bolt hole for supporting the link of the rivet to be dismantled, a female screw fastened in said first bolt hole, a pressure screw driven by a telescopic lever to screw in said female screw causing said rivet to be disconnected from either side-plate of said link, and characterized in that said in said bottom platform has a notch on a front face thereof, and said screw thread bush has a side opening longitudinally disposed in line with said side notch for passing therethrough of said rivet and said link after said rivet having been dismantled from either side-plate of said link.

2 Claims, 5 Drawing Sheets

BICYCLE CHAIN RIVET DISMANTLING APPARATUS

BACKGROUND OF THE INVENTION

The present invention relates to hand tools, and more particularly, the present invention relates to an apparatus used in dismantling the rivets of a bushed chain.

In dismantling a rivet of a bushed chain, a suitable tool shall be used. FIGS. 1, 2 and 3 illustrate two different apparatus for this purpose. In FIG. 1, the apparatus has a notch B on the bottom A of the base (10) thereof. Rotating the tommy screw (11) inwards in the top bolt hole (101) causes a rivet (12) to be moved out of a link (13) of a bushed chain. However, because of the arrangement of the notch B, dismantling a rivet (12) from one side-plate of a link (13) of a bushed chain may cause a rivet (12) to be completely disconnected from the two opposite side-plates of a link (13). Once a rivet has been removed from the two opposite side-plates of a link, it is very difficult to insert the rivet back into the holes on the two opposite side-plates of the link again. Further, because the side-plates of each link (13) of a UG chain respectively curve outwards, a link will be caused to deform when the rivet thereon is squeezed by the tommy screw (11) during a rivet dismantling process (see FIG. 2).

In order to eliminate the aforesaid problems, there is provided an another structure of apparatus, as shown in FIG. 3, for removing rivets from a bushed chain. In this structure, the base (20) has a bolt hole fastened with a hollow screw means (21). The hollow screw means (21) has a top edge (22) used in supporting the side-plates of the link (23) mounted thereon, so that the two opposite side-plates of the links (23) will not be caused to deform when the rivet (24) thereof is squeezed by the front pressure rod (26) of the tommy screw (25) which is inserted through the top bolt hole (201) of the base (20). However, once a rivet (24) has been pushed out of one side-plate of a link (23) by the tommy screw (25), the tommy screw (25) must be rotated outwards to move the front pressure rod (26) away from the rivet hole (241) on such side-plate, so that the rivet (24) can be moved out of the hole (211) of the hollow screw (21) permitting the chain to be taken out of the apparatus. Further, the top bolt hole (101;201) is formed on the base (10;20) at an offset location for screwing the tommy screw (11;25). Frequently screwing the tommy screw (11;25) in the top bolt hole (101;201) may damage the threads of the top bolt hole (101;201) easily. Although the top bolt hole (101;201) can be strengthened through a heat treating process, the threads of the top bolt hole (101;201) may be caused to deform easily during a heat treating process because the top bolt hole (101;201) provides different coefficient of contraction due to its uneven wall thickness. Therefore, this structure of chain rivet dismantling apparatus is not durable in use.

SUMMARY OF THE INVENTION

The present invention has been accomplished to eliminate the aforesaid disadvantages. According to the present invention, there is provided a bicycle chain rivet dismantling apparatus which is generally comprised of a base having a first bolt hole and a second bolt hole longitudinally aligned at two opposite ends thereof and spaced from an intermediate stop wall, a screw thread bush fastened in said second bolt hole for supporting the link of the rivet to be dismantled, a female screw fastened in said first bolt hole, a pressure screw driven by a telescopic lever to screw in said female screw causing said rivet to be disconnected from either side-plate of said link. The bottom platform of the base has a notch on a front face thereof longitudinally disposed in line with a side opening on the screw thread for passing therethrough of a rivet and a link after such rivet having been dismantled from either side-plate of such link. The female screw and the pressure screw are respectively treated through a heat treating process to reinforce their structural strength, and therefore, the service life of the apparatus is greatly extended.

DETAILED DESCRIPTION OF THE PREFERRED EMBODIMENT

Figure 1:
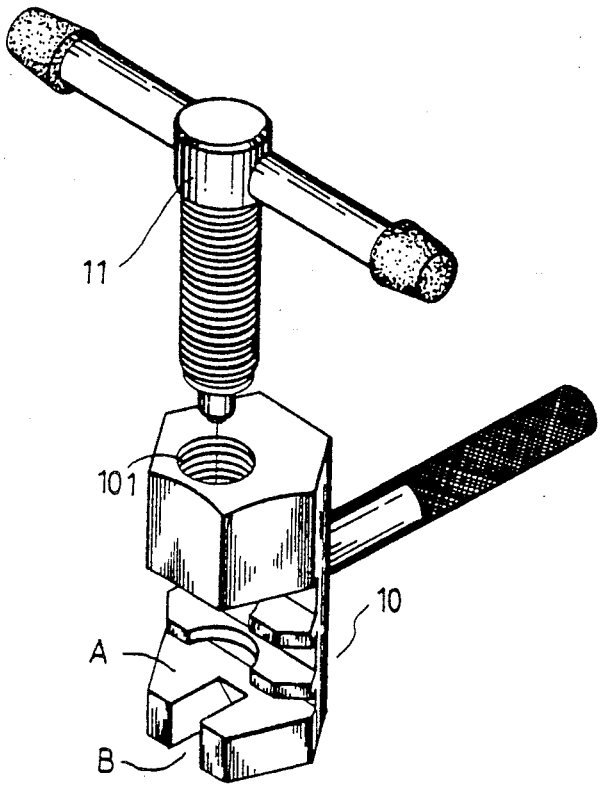
FIG. 1 PRIOR ART
FIG. 1 is a dismantled view of a chain rivet dismantling apparatus according to the prior art.
Figure 2:
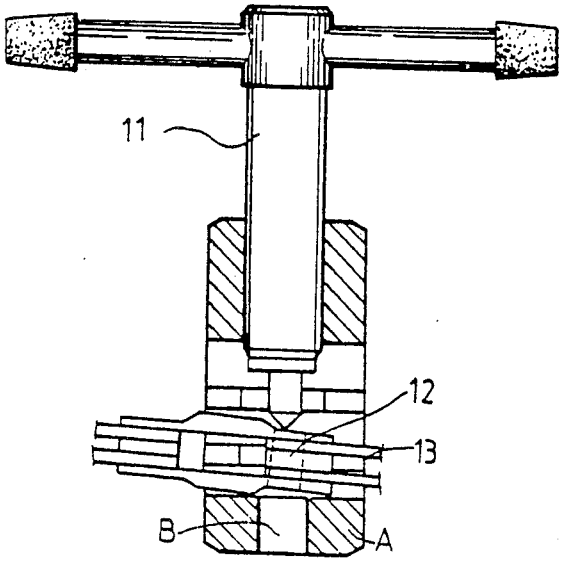
FIG. 2 PRIOR ART
FIG. 2 is a sectional view of the chain rivet dismantling apparatus of FIG. 1 showing its operation in pushing a rivet out of one side-plate of a link of a bushed chain.
Figure 3:
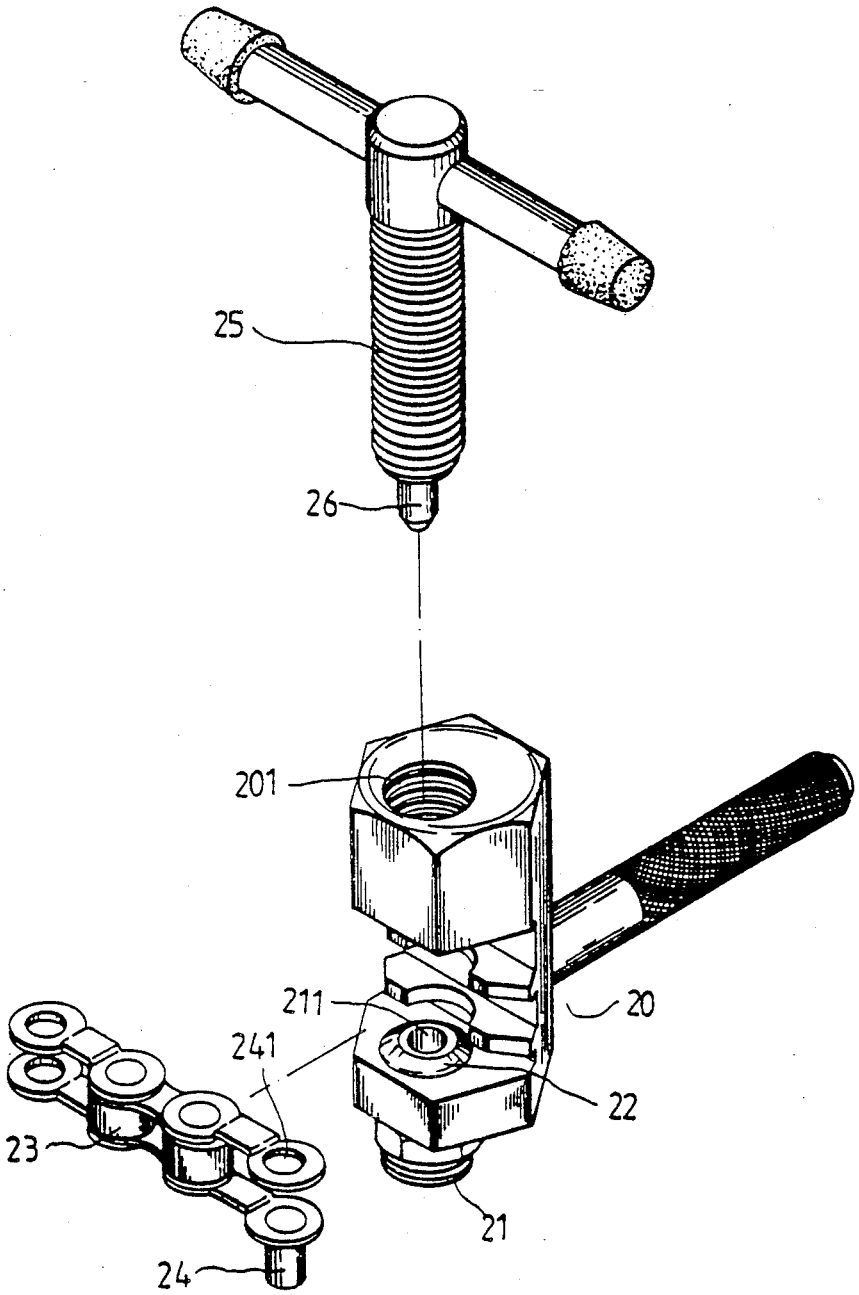
FIG. 3 PRIOR ART
FIG. 3 is a dismantled view of another structure of chain rivet dismantling apparatus according to the prior art.
Figure 4:
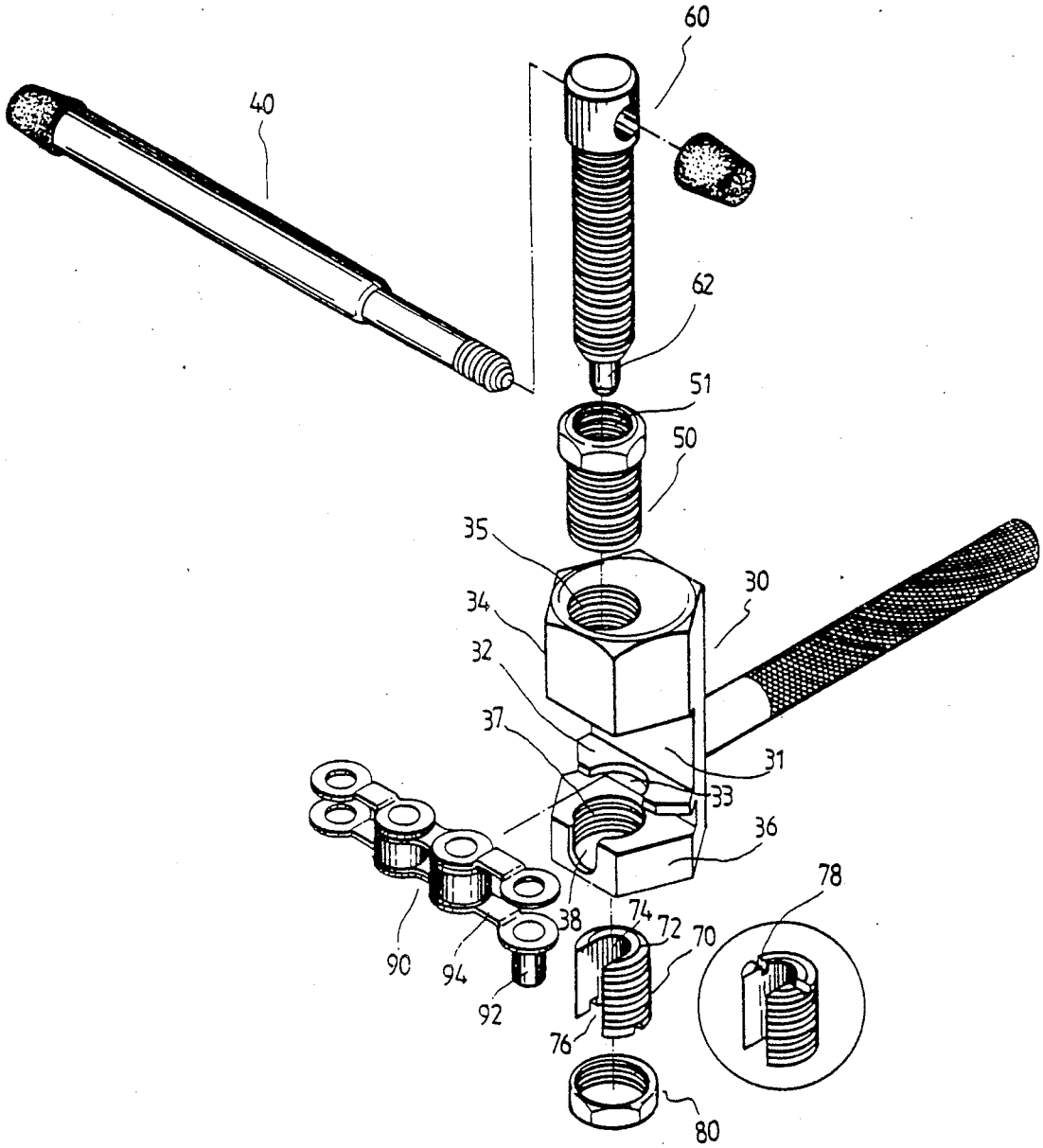
FIG. 4 is a dismantled view of a chain rivet dismantling apparatus according to the present invention.
Figure 5:
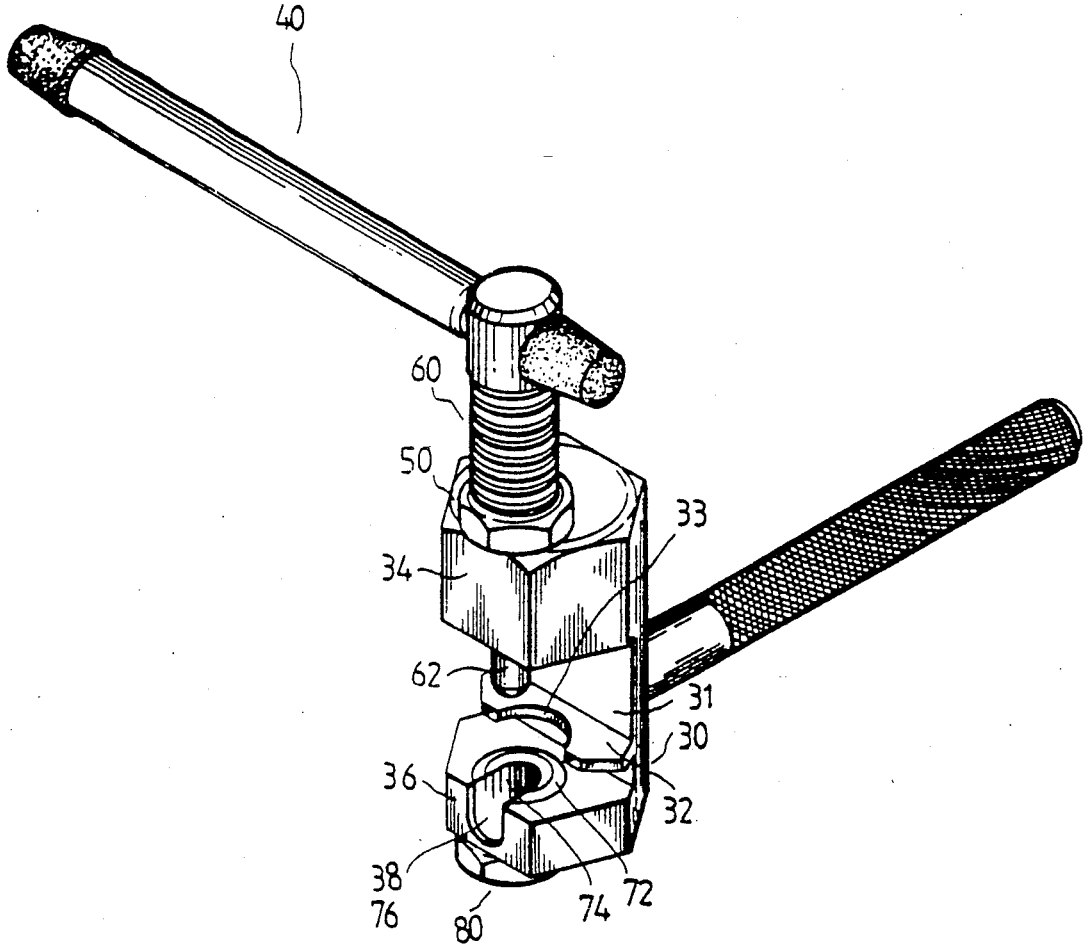
FIG. 5 is an elevational view of the chain rivet dismantling apparatus of FIG. 4.

Referring to FIGS. 4 and 5, therein illustrated is a chain rivet dismantling apparatus according to the present invention, which is generally comprised of a base 30, a telescopic lever 40, a female screw 50, a pressure screw 60, a screw thread bush 70, and a lock nut 80. The base 30 is made from an elongated block comprised of a top platform 34 transversely disposed at the top end thereof, a bottom platform 36 transversely disposed at the bottom end thereof, a vertical side wall 31 vertically peripherally connected between said top and bottom platforms 34, 36, a transverse stop wall 32 transversely extending from said vertical side wall 31 and disposed between said top and bottom platforms 34, 36, wherein said top platform 34 has a bolt hole 35 for fastening the female screw 50; said bottom platform 36 has a bolt hole 37 for fastening the screw thread bush 70 and a side notch 38 on the front face thereof; said stop wall 32 has a curved notch 33 disposed in line with the bolt holes 35, 37 for holding a bushed chain 90. The female screw 50 has an inner thread portion 51 over the boring bore thereof for screwing the pressure screw 60. The pressure screw 60 has a pressure rod 62 on the bottom edge thereof. The top end of the pressure screw 60 is coupled with the telescopic lever 40, and therefore, rotating the telescopic lever 40 causes the pressure screw 60 to rotate upwards or downwards in the female screw 50. Rotating the pressure screw 60 downwards causes the pressure rod 62 to press a rivet 92 out of the link 94 of the bushed chain 90 which is supported on the stop wall 32 and the bottom platform 36. The screw thread bush 70 has a ring-shaped top projection 72 on the top edge around the boring bore 74 thereof, and a side opening 76 longitudinally disposed through the peripheral wall thereof.

Figure 6:
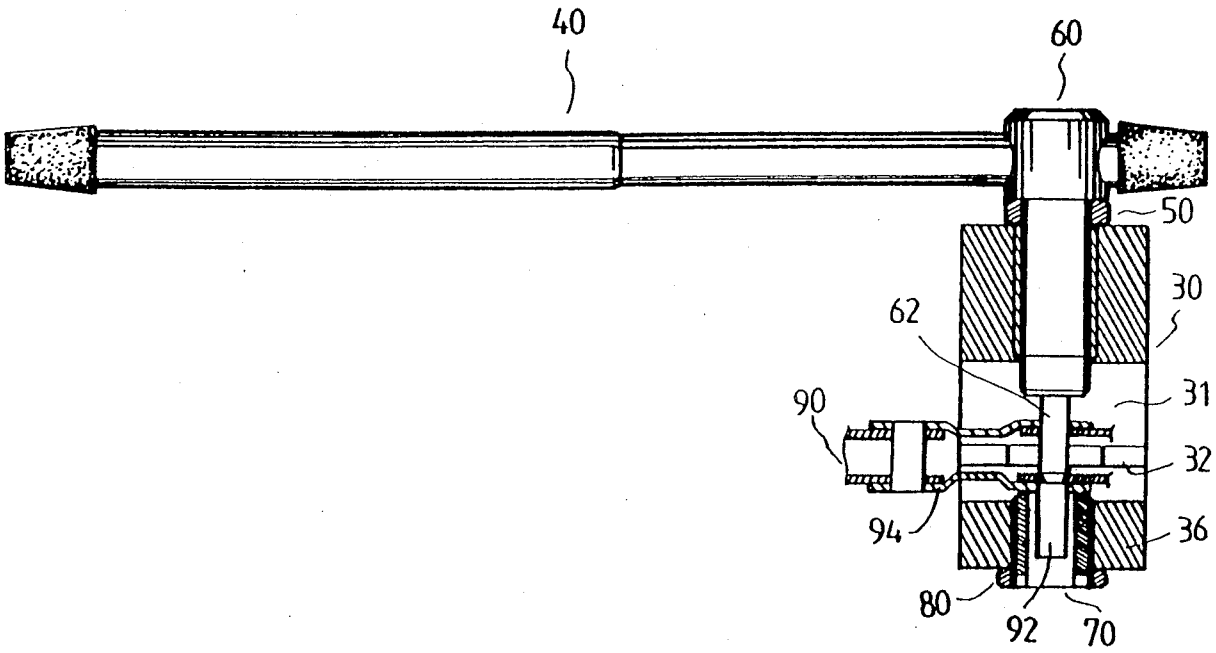
FIG. 6 is a partly sectional view showing the operation of the chain rivet dismantling apparatus of FIG. 4 in pushing a rivet out of one side-plate of a link of a bushed chain.

Referring to FIG. 6, when a bushed chain 90 has been placed on the bottom platform 36, the screw thread bush 70 is screwed upwards in the bolt hole 37 with its top projection 72 stopped against the bottom side-plate of the link 94 around the rivet 92 thereof. Therefore, the rivet 92 can be pushed downwards into the boring bore 74 of the screw thread bush 70. The outer thread portion of the pressure screw 60 is so arranged that the rivet 92 will not be completely disconnected from the link 94 of the bushed chain 90 once the pressure screw 60 has been rotated to its lower limit stroke (i.e., the rivet 92 will be disconnected from the top side-plate of the link 94 but will still be retained in the bottom side-plate of the link 94). Further, because of the arrangement of the side notch 38 and the side opening 76 which permit the rivet 92 to be moved out of the bottom platform 36, when the pressure screw 60 has been rotated upwards from the link 94 after, the bushed chain 90 can be directly taken out of the base 30 without screwing the pressure screw 60 back to its upper limit position.

Referring to FIG. 4 again, the screw thread bush 70 further comprises a opposite groove 78 through the bottom edge thereof for driving a screw driver. Therefore, the screw thread bush 70 can be conveniently rotated upwards or downwards in the bolt hole 37 on the bottom platform 36 in adjusting the range between the ring-shaped top projection 72 and the stop wall 32 according to the size of the bushed chain to be dismantled. However, the total length of the screw thread bush 70 shall be longer than the depth of the bolt hole 37, so that the lock nut 80 can be fastened on the screw thread bush 70 at the bottom end thereof out of the bottom edge of the bottom platform 36, permitting the screw thread bush 70 to be firmly retained in place. Further, the telescopic lever 40 can be extended out for rotating the pressure screw 60 in the female screw 50 efficiently. When not in use, the telescopic lever 40 can be collapsed so as to reduce its space occupation. In order to extend the service life of the apparatus, the female screw 50 (including its inner thread portion 51) and the pressure screw 60 are treated through a heat treating process.

What is claimed is:

1. A bicycle chain rivet dismantling apparatus comprising:

a base, said base comprised of a top platform transversely disposed at the top end thereof, a bottom platform transversely disposed at the bottom end thereof, a vertical side wall vertically peripherally connected between said top and bottom platforms, a transverse stop wall transversely extending from said vertical side wall and disposed between said top and bottom platforms, a first bolt hole on said top platform, a second bolt hole on said bottom platform longitudinally aligned with said first bolt hole, said stop wall having a curved notch disposed in line with said first and second bolt holes;

a female screw fastened in said first bolt hole, said female screw having an inner thread portion through the longitudinal axis thereof;

a pressure screw screwed into said inner thread portion of said female screw, said pressure screw having a pressure rod on a bottom edge thereof;

a telescopic lever fastened in a hole on said pressure screw and rotated to move said pressure rod downwards toward said curved notch and said second bolt hole, or upwards away from said curved notch;

a screw thread bush fastened in said second bolt hole, said screw thread bush having a top projection on a top edge around a boring bore thereof, and a groove through a bottom edge thereof for driving a screw driver;

a lock nut mounted on said screw thread bush and attached to said bottom platform at a bottom edge thereof in securing said screw thread bush in place; and characterized in that said bottom platform has a notch on a front face thereof, and said screw thread bush has a side opening longitudinally disposed in line with said side notch for moving in and out of a partly dismantled rivet of a link of a bushed chain.

2. The apparatus of claim 1, wherein said female screw and said pressure screw are treated through a heat treating process to reinforce their structural strength.

* * * * *